US008642975B2

(12) United States Patent
Noda et al.

(10) Patent No.: US 8,642,975 B2
(45) Date of Patent: Feb. 4, 2014

(54) ION GENERATING DEVICE

(75) Inventors: Yoshiyuki Noda, Osaka (JP); Makoto Kitahira, Osaka (JP); Akihito Namikawa, Kariya (JP); Kenichi Kato, Kariya (JP); Kazushi Shikata, Kariya (JP)

(73) Assignees: Sharp Kabushiki Kaisha, Osaka (JP); Denso Corporation, Kariya (JP)

( * ) Notice: Subject to any disclaimer, the term of this patent is extended or adjusted under 35 U.S.C. 154(b) by 0 days.

(21) Appl. No.: 13/882,634

(22) PCT Filed: Oct. 31, 2011

(86) PCT No.: PCT/JP2011/075080

§ 371 (c)(1),
(2), (4) Date: Apr. 30, 2013

(87) PCT Pub. No.: WO2012/060332

PCT Pub. Date: May 10, 2012

(65) Prior Publication Data

US 2013/0214173 A1 Aug. 22, 2013

(30) Foreign Application Priority Data

Nov. 1, 2010 (JP) ..... 2010-245422

(51) Int. Cl.
*H01J 27/02* (2006.01)

(52) U.S. Cl.
USPC ..... 250/423 R; 250/424

(58) Field of Classification Search
None
See application file for complete search history.

(56) References Cited

U.S. PATENT DOCUMENTS

| | | | | |
|---|---|---|---|---|
| 2004/0036020 | A1 * | 2/2004 | Sakairi et al. | 250/288 |
| 2007/0235663 | A1 * | 10/2007 | Low et al. | 250/492.1 |
| 2007/0237281 | A1 * | 10/2007 | Yakovlyev | 376/157 |
| 2008/0067410 | A1 * | 3/2008 | Shigehiro et al. | 250/423 R |
| 2008/0067411 | A1 * | 3/2008 | Nishino et al. | 250/423 R |
| 2008/0277593 | A1 * | 11/2008 | Fujita et al. | 250/423 R |
| 2011/0044418 | A1 * | 2/2011 | Stubbers et al. | 376/116 |

FOREIGN PATENT DOCUMENTS

| | | | | |
|---|---|---|---|---|
| JP | 10079231 | A * | 3/1998 | H01J 27/02 |
| JP | 2004-111135 | A | 4/2004 | |
| JP | 2004111135 | A * | 4/2004 | H01T 23/00 |
| JP | 2006-127855 | A | 5/2006 | |
| JP | 2006127855 | A * | 5/2006 | |
| JP | 2008-123917 | A | 5/2008 | |
| JP | 2008123917 | A * | 5/2008 | |
| JP | 2009-266664 | A | 11/2009 | |
| JP | 2009266664 | A * | 11/2009 | |
| SU | 1053186 | A * | 11/1983 | |

* cited by examiner

*Primary Examiner* — Andrew Smyth
(74) *Attorney, Agent, or Firm* — Birch, Stewart, Kolasch & Birch, LLP

(57) ABSTRACT

To prevent a reduction in an amount of an ion emission while preventing generation of electromagnetic noise. A high-voltage generating circuit section (2) that supplies a high voltage to an ion generating element (1) that generates ions is housed in a housing (3), and sealed with filled resin (22). An emission port (12) for emitting the generated ions is formed in the housing (3), and an outer surface of the housing except the emission port is covered with a shield case (30). A passage port (33) communicating with the emission port is formed in the shield case. A periphery of the passage port of the shield case is covered with an electrically insulating covering sheet (36) so that emitted ions do not adhere to the shield case. The ions emitted from the emission port do not adhere to the shield case covered with the covering sheet.

13 Claims, 8 Drawing Sheets

(a)

(b)

(a)

(b)

ION GENERATING DEVICE

BACKGROUND OF THE INVENTION

1. Field of the Invention

The present invention relates to an ion generating device that generates ions in air by corona discharge.

2. Background Art

FIG. 8 shows an ion generating device that generates ions by corona discharge. The ion generating device includes an ion generating element 1 that generates ions, a high-voltage generating circuit section 2 that supplies a high voltage to the ion generating element 1, and a housing 3 that houses the ion generating element 1 and the high-voltage generating circuit section 2. An opening 4 is formed in a front surface of the housing 3, and the ion generating element 1 is mounted to the housing 3 at the opening 4. The high-voltage generating circuit section 2 is mounted in the housing 3.

The ion generating element 1 includes a discharge electrode 5 and an induction electrode 6. The discharge electrode 5 is a needle-like electrode, and positive and negative discharge electrodes 5 are mounted on the circuit board 7. The induction electrodes 6 are formed of a sheet metal having a hole, and placed to face and surround the positive and negative discharge electrodes 5, and mounted on the circuit board 7. There is a certain distance between a peripheral edge of the induction electrode 6 and the discharge electrode 5, and a discharge space is formed between the electrodes 5, 6.

The high-voltage generating circuit section 2 includes a high-voltage transformer 8, a connector 9 for power connection, a control circuit, and other electronic components, which are mounted on a control board 10. The control board 10 is inserted and held in the housing 3.

A discharge cover 11 is provided on the front surface of the housing 3 so as to cover the ion generating element 1. Ion emission ports 12 are formed in the discharge cover 11 so as to face the discharge electrodes 5. A seal member 13 surrounding the discharge cover 11 is provided. When the ion generating device is incorporated into an electrical device such as an air conditioner for use, the ion generating device is mounted to a duct, and the seal member 13 is sealed to a wall surface of the duct to prevent air leakage. In FIG. 8, reference numeral 14 denotes a securing foot for mounting.

If the high-voltage generating circuit section 2 applies a high voltage between the discharge electrode 5 and the induction electrode 6, corona discharge occurs at a tip of the discharge electrode 5, and one or both of positive and negative ions are generated. The generated ions are emitted from the emission ports 12 to an outside. Blowing air into the ion generating device diffuses the generated ions into air.

In the ion generating device, a high voltage is generated and applied to the electrodes, thereby generating electromagnetic noise. The electromagnetic noise affects surrounding electrical devices. For example, the electromagnetic noise disturbs TV images or generates noise in radio sound. To prevent such electromagnetic noise, measures have been taken such as to cover a high-voltage transformer with a metal cap (Patent Literature 1), to inject filled resin into a housing for insulation molding to insulation mold a high-voltage generating circuit section (Patent Literature 2), and to house a housing in a metal box integrally provided with an induction electrode (Patent Literature 3).

CITATION LIST

Patent Literature

Patent Literature 1: Japanese Patent Laid-Open No. 2004-111135

Patent Literature 2: Japanese Patent Laid-Open No. 2006-127855

Patent Literature 3: Japanese Patent Laid-Open No. 2008-123917

SUMMARY OF INVENTION

Technical Problem

The above described measures can reduce electromagnetic noise. However, shielding the housing with a metal box reduces an amount of an ion emission. Specifically, ions generated by discharge adhere to the metal box to reduce an amount of emitted ions.

Thus, in view of the above, the present invention has an object to provide an ion generating device that can prevent a reduction in the amount of the ion emission while preventing generation of electromagnetic noise.

Solution to Problem

The present invention provides an ion generating device, wherein a high-voltage generating circuit section that supplies a high voltage to an ion generating element that generates ions is housed in a housing, an emission port for emitting the generated ions is formed in the housing, an outer surface of the housing except the emission port is covered with a shield case, and the shield case is covered with an insulating section so that the emitted ions do not adhere to the shield case. The insulating section is an insulating film provided on an outer surface of the shield case and having an electrically insulating property, and, for example, a covering sheet or a coating film.

The generated ions are emitted from the emission port in the housing to an outside. The ions may electrically adhere to the shield case, but the shield case covered with the insulating section is electrically insulated to prevent the ions from adhering to the shield case.

A passage port communicating with the emission port is formed in the shield case, and the insulating section covers a periphery of the passage port. The periphery of the passage port of the shield case is a surface that may come into contact with the emitted ions. The insulating section is provided on the surface and prevents the ions from coming into contact with the surface. The insulating section is not provided on a surface of the shield case that is not likely to come into contact with the ions, thereby eliminating excessive measures against electromagnetic noise.

An end surface of the passage port of the shield case is covered with the insulating section so as not to be exposed to the emission port. The ions emitted from the emission port pass through the passage port to the outside. Thus, the end surface of the passage port is a surface that may come into contact with the ions. Since the insulating section is provided on the end surface of the passage port, no ions adhere to the end surface.

A rib protruding outward is formed on a peripheral edge of the emission port in the housing, and the rib is the insulating section that covers the end surface of the passage port of the shield case. The end surface of the passage port comes into contact with the rib, and is thus covered with the rib. The end surface of the passage port can be prevented from coming into contact with the ions.

The rib of the housing is flush with the insulating section covering the outer surface of the shield case or protrudes outward beyond the insulating section. Specifically, the insulating section does not protrude outward beyond the rib. This prevents the end surface of the passage port from being exposed to the emission port, and can reliably prevent the ions from coming into contact with the end surface of the passage port.

The insulating section covers the outer surface of the shield case facing a space into which the ions are emitted. The outer surface of the shield case facing the space is a surface that may come into contact with the ions. Thus, the outer surface of a part of the shield case facing the space or the entire surface of the shield case is covered with the insulating section.

Advantageous Effects of Invention

According to the present invention, the shield case covers the housing to prevent generation of electromagnetic noise from the housing. The shield case is covered with the insulating film, thereby preventing the emitted ions from electrically adhering to the shield case, and preventing a reduction in the emitted ions.

DETAILED DESCRIPTION OF THE INVENTION

Figure 1:
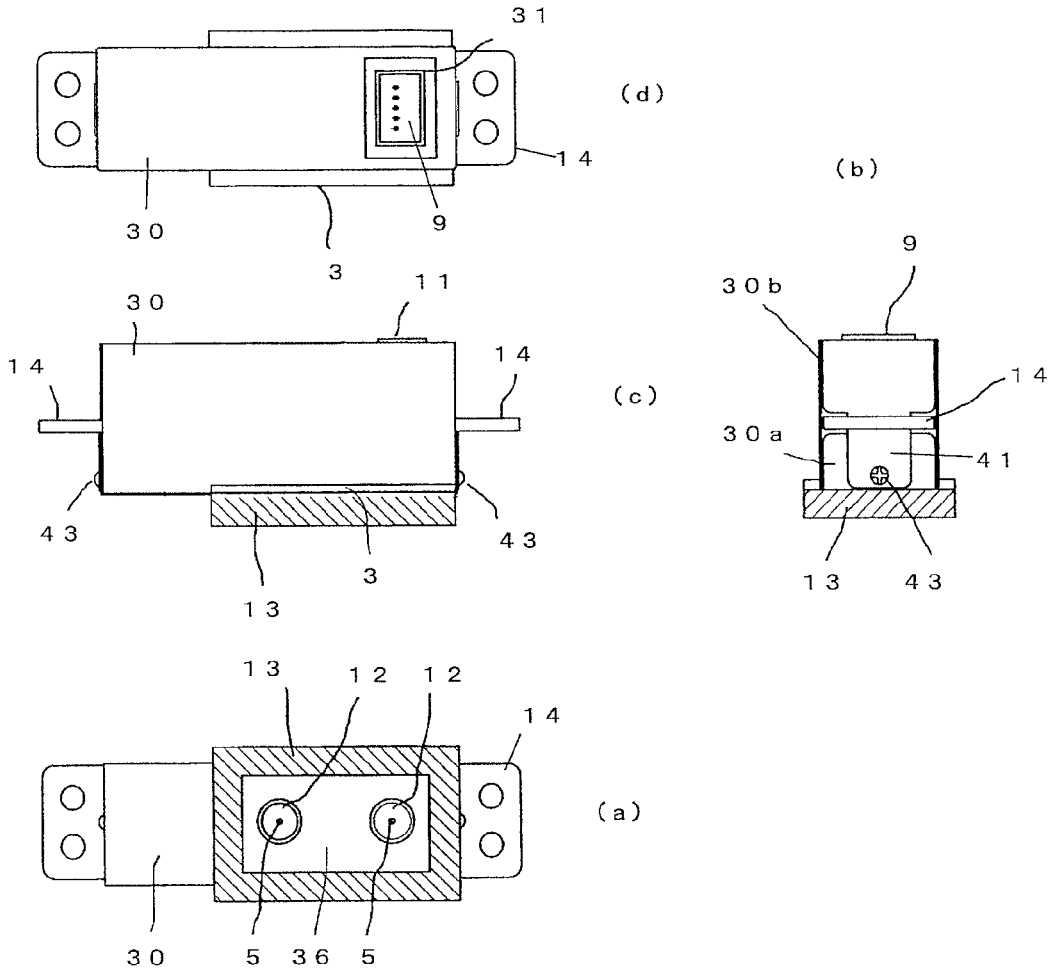
FIG. 1 shows an appearance of an ion generating device of the present invention, FIG. 1(*a*) is a front view, FIG. 1(*b*) is a side view, FIG. 1(*c*) is a plan view, and FIG. 1(*d*) is a back view.
Figure 2:
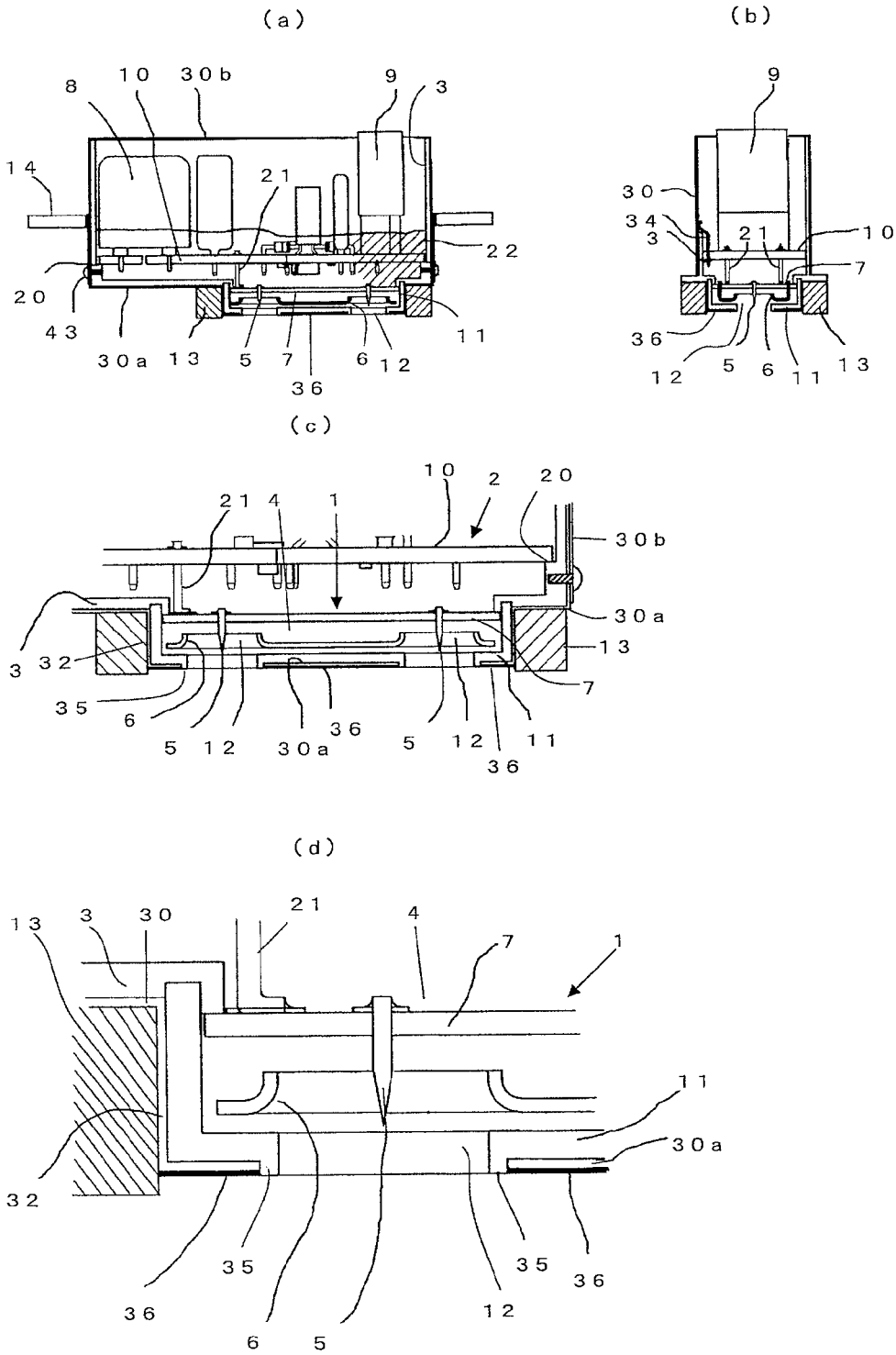
FIG. 2 shows an inner structure of the ion generating device, FIG. 2(*a*) is a sectional view seen from above, FIG. 2(*b*) is a sectional view seen from side, FIG. 2(*c*) is a sectional view near an emission port in a housing, and FIG. 2(*d*) is an enlarged sectional view of the emission port.
Figure 3:
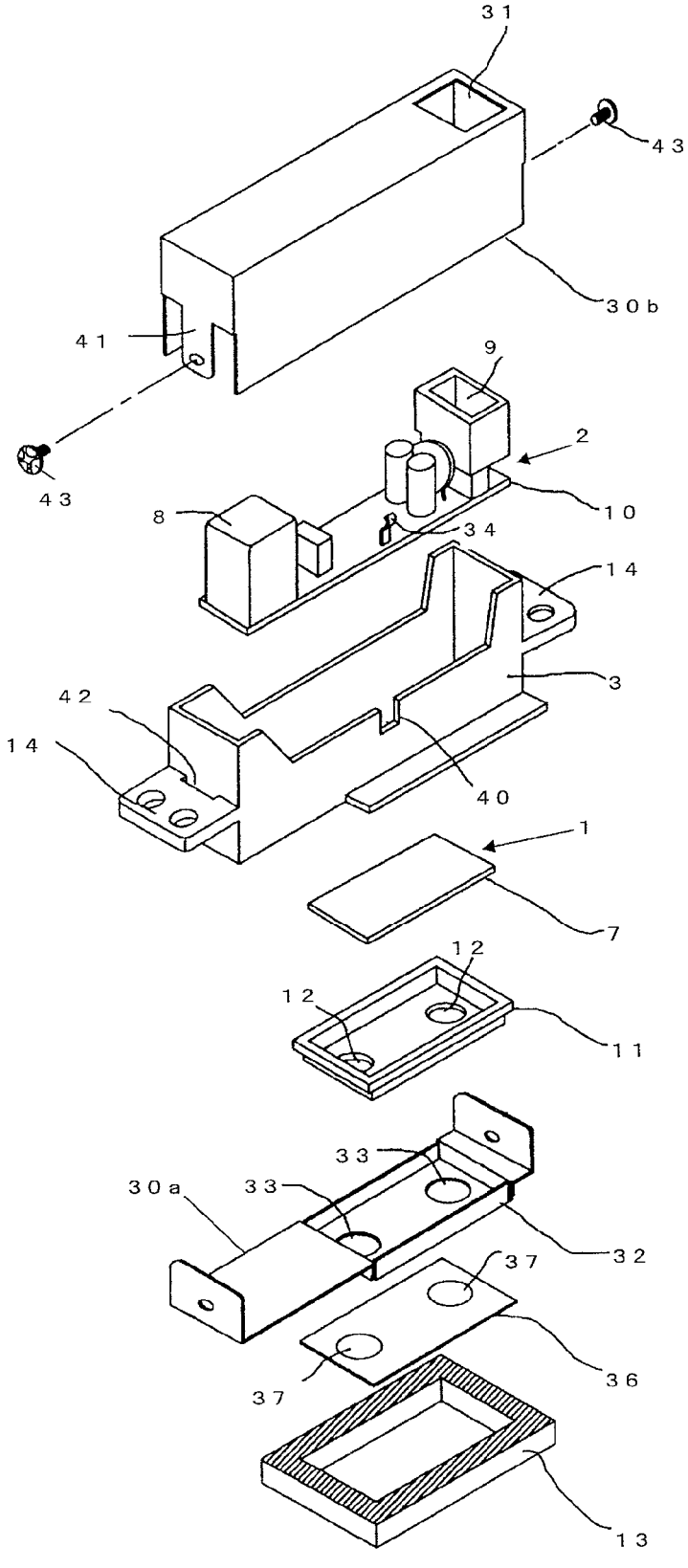
FIG. 3 is an exploded perspective view of the ion generating device.
Figure 8:
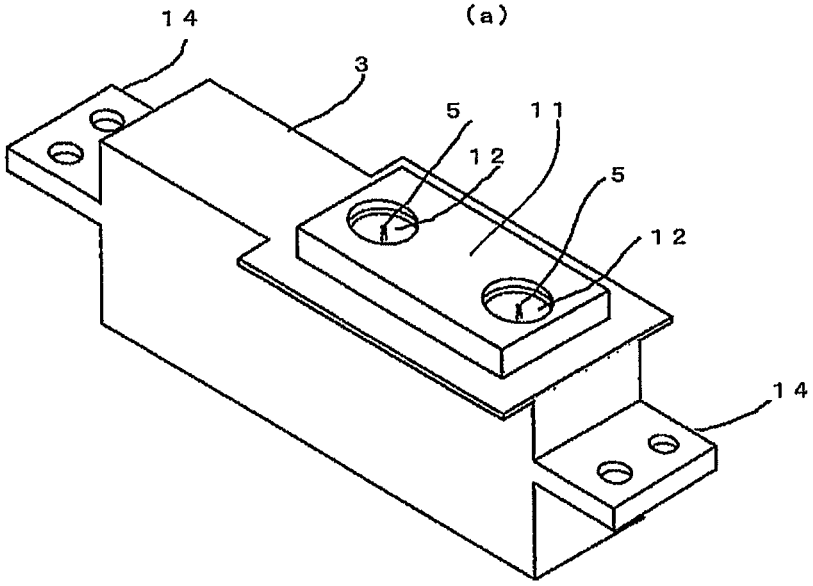
PRIOR ART FIG. 8
FIG. 8 shows a conventional ion generating device, FIG. 8(*a*) is a perspective view, and FIG. 8(*b*) is a sectional view.
Figure 8:
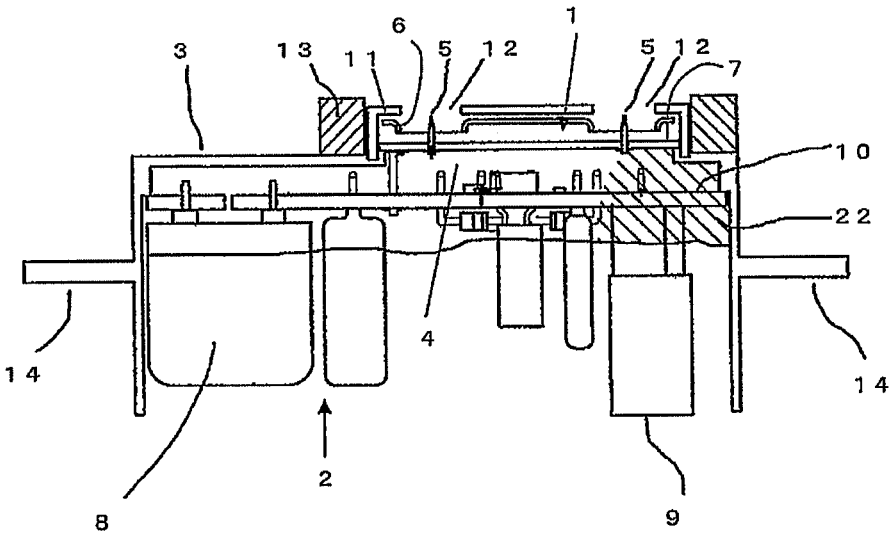
PRIOR ART FIG. 8

FIGS. 1 to 3 show an ion generating device of this embodiment. The ion generating device has the same basic structure as a conventional one shown in FIG. 8, and an ion generating element 1 and a high-voltage generating circuit section 2 are provided in a housing 3. The housing 3 is formed of resin into a box shape, and an opening 4 for mounting the ion generating element is formed in a front surface of the housing 3, and a rear surface is opened.

The ion generating element 1 includes positive and negative discharge electrodes 5, and induction electrodes 6 placed to face the discharge electrodes 5. A circuit board 7 on which the electrodes 5, 6 are mounted is fitted in the opening 4 in the housing 3, and an outer peripheral portion of the circuit board 7 is bonded to the housing 3 to mount the circuit board 7. A discharge cover 11 having an ion emission port 12 is placed to cover the ion generating element 1, and bonded and mounted to the housing 3. The discharge cover 11 made of resin is integrated with the housing 3. Specifically, the discharge cover 11 forms a part of the housing 3, and the circular emission port 12 is formed in the housing 3.

The high-voltage generating circuit section 2 includes a control board 10 on which a high-voltage transformer 8, a connector 9, an electronic component, or the like are mounted. The control board 10 is housed in the housing 3, and supported by a board holding section 20 provided on an inner wall of the housing 3.

The control board 10 of the high-voltage generating circuit section 2 and the circuit board 7 of the ion generating element 1 are electrically connected by a plurality of connection terminals 21. The high-voltage transformer 8 and the positive and negative discharge electrodes 5 are electrically connected through the connection terminals 21. The high-voltage transformer 8 is covered with a conductive shield cap.

The control board 10 of the high-voltage generating circuit section 2 is sealed in the housing 3 with filled resin 22 except conductive terminals of a print pattern and an electronic component and a connecting conductive terminal of the connector 9. This molding ensures a moisture-resistant insulating property of the high-voltage generating circuit section 2. When filling with the filled resin 22, the circuit board 7 of the ion generating element 1 seals the opening 4 in the housing 3 so as to prevent leakage of the filled resin 22.

Figure 4:
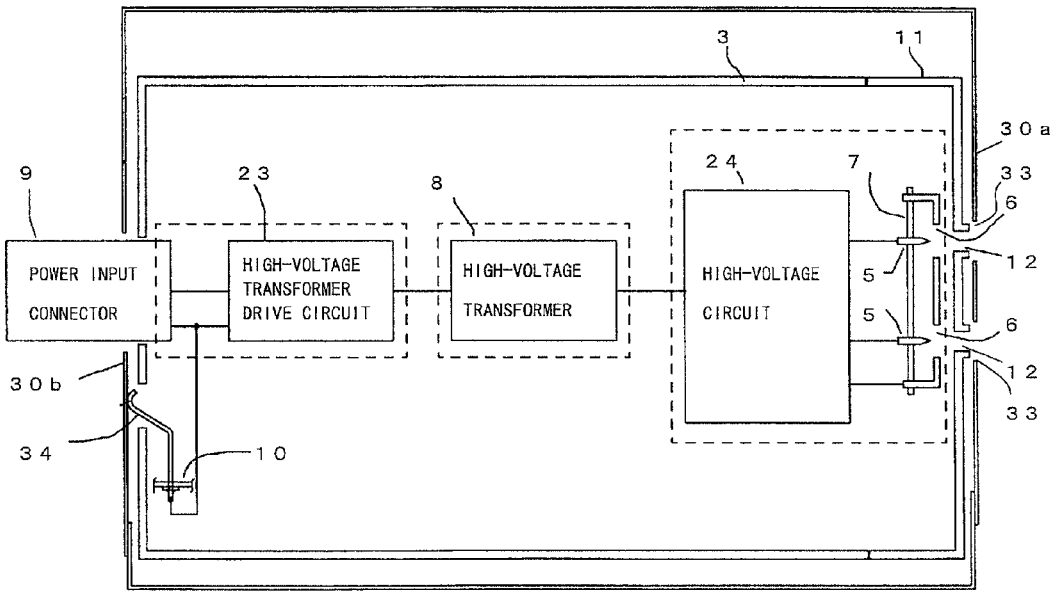
FIG. 4 is a block diagram of a high-voltage generating circuit section.

As shown in FIG. 4, the high-voltage generating circuit section 2 includes a high-voltage transformer drive circuit 23 that drives the high-voltage transformer 8, and a high-voltage circuit 24 that applies a high voltage to the discharge electrode 5. The connector 9 for inputting power is connected to the high-voltage transformer drive circuit 23, and the connector 9 connected to an external power source such as a commercial power source supplies power to the high-voltage transformer drive circuit 23. The high-voltage transformer drive circuit 23 includes an ON/OFF circuit for generating ions and an oscillation circuit for generating a high voltage, and functions as a control circuit that drives the ion generating element 1.

The high-voltage transformer drive circuit 23 to which power is supplied operates to output an oscillation signal. The high-voltage transformer 8 driven by receiving the oscillation signal from the high-voltage transformer drive circuit 23 generates a high voltage, and supplies an AC high voltage to the high-voltage circuit 24. The high-voltage circuit 24 selects positive and negative voltages from the supplied high voltage, and outputs a high voltage to the positive or negative discharge electrode 5.

The housing 3 is covered with a conductive shield case 30 to reduce electromagnetic noise from the device. The shield case 30 covers the outer surface of the housing 3 except the emission port 12. The shield case 30 is divided into a front case 30*a* and a rear case 30*b* made of metal. The rear case 30*b* is formed into a box shape with a front surface being opened, and houses the housing 3. An opening 31 for the connector is formed in a rear surface of the rear case 30*b*. The front case 30*a* is formed into a lid shape and covers the front surface of the housing 3 to which the discharge cover 11 is mounted. A part of the front case 30*a* covering the discharge cover 11 protrudes forward to form a protruding section 32. A pair of circular passage ports 33 communicating with the emission ports 12 are formed in the protruding section 32. The shield case 30 is in contact with a contact terminal 34 mounted to the control board 10. The contact terminal 34 is connected to the ground of the power source, and the shield case 30 is grounded through the contact terminal 34.

An annular rib 35 is formed in the peripheral edge of the emission port 12 in the housing 3. The rib 35 is formed to protrude forward (outward), and protrudes forward beyond the protruding section 32 of the shield case 30. The passage port 33 in the shield case 30 has a large diameter than the emission port 12, the rib 35 is fitted in the passage port 33, and an end surface of the passage port 33 is sealed to the rib 35. Specifically, the end surface of the passage port 33 is covered with the rib 35.

The seal member 13 is provided around the protruding section 32 of the shield case 30. The seal member 13 is formed of an elastic material such as rubber into a frame shape so as to surround the protruding section 32. The seal member 13 is attached to the shield case 30, and when the ion generating device is mounted to the duct or the like, the seal member 13 closes a gap between the duct and the shield case 30 to prevent air leakage.

The shield case 30 is covered with an insulating section so as to prevent the emitted ions from adhering to the shield case 30. The protruding section 32 of the shield case 30 is covered with a covering sheet 36 having an electrically insulating property. The covering sheet 36 is an insulating section. The covering sheet 36 made of resin has two holes 37 corresponding to the passage ports 33, and the covering sheet 36 is attached to the front surface of the protruding section 32 so as to cover peripheries of the passage ports 33. A thickness of the covering sheet 36 is set so that the rib 35 is flush with the covering sheet 36 or protrudes forward beyond the covering sheet 36.

An end surface of the passage port 33 in the shield case 30 is covered with the rib 35 of the housing 3 having an electrically insulating property. Thus, the rib 35 is also an insulating section.

Next, with reference to FIG. 3, an assembling procedure of the ion generating device will be described. First, the circuit board 7 of the ion generating element 1 is bonded and mounted to the opening 4 in the housing 3. The discharge cover 11 is bonded and mounted to the front surface of the housing 3 so as to cover the opening 4 in the housing 3. Then, the control board 10 is inserted into the housing 3 with the rear surface of the housing 3 up. The control board 10 is supported by the board holding section 20. At this time, a tip of the contact terminal 34 is in the state of protruding outward from a notch 40 formed in the housing 3. The connection terminal 21 mounted to the circuit board 7 of the ion generating element 1 is fitted in a through hole in the control board 10, and soldered to the control board 10.

Then, the filled resin 22 is injected into the housing 3 from above. After curing of the filled resin 22, the front case 30*a* is placed over the front surface of the housing 3, and the rear case 30*b* is also placed over the rear surface of the housing 3. A securing piece 41 is formed on a side surface of the rear case 30*b*, and inserted into a through hole 42 formed in the securing foot 14 of the housing 3. The securing piece 41 overlaps the side surface of the front case 30*a*, and is secured by a screw 43. Thus, the front case 30*a* and the rear case 30*b* are integrated to form one shield case 30. The contact terminal 34 comes into contact with the inner surface of the shield case 30, and the shield case 30 is brought into conduction with the ground, and thus the shield case 30 reduces electromagnetic noise.

The covering sheet 36 is attached to the front surface of the protruding section 32 on the front case 30*a* of the shield case 30. The seal member 13 is attached to the front case 30*a* around the protruding section 32.

Figure 5:
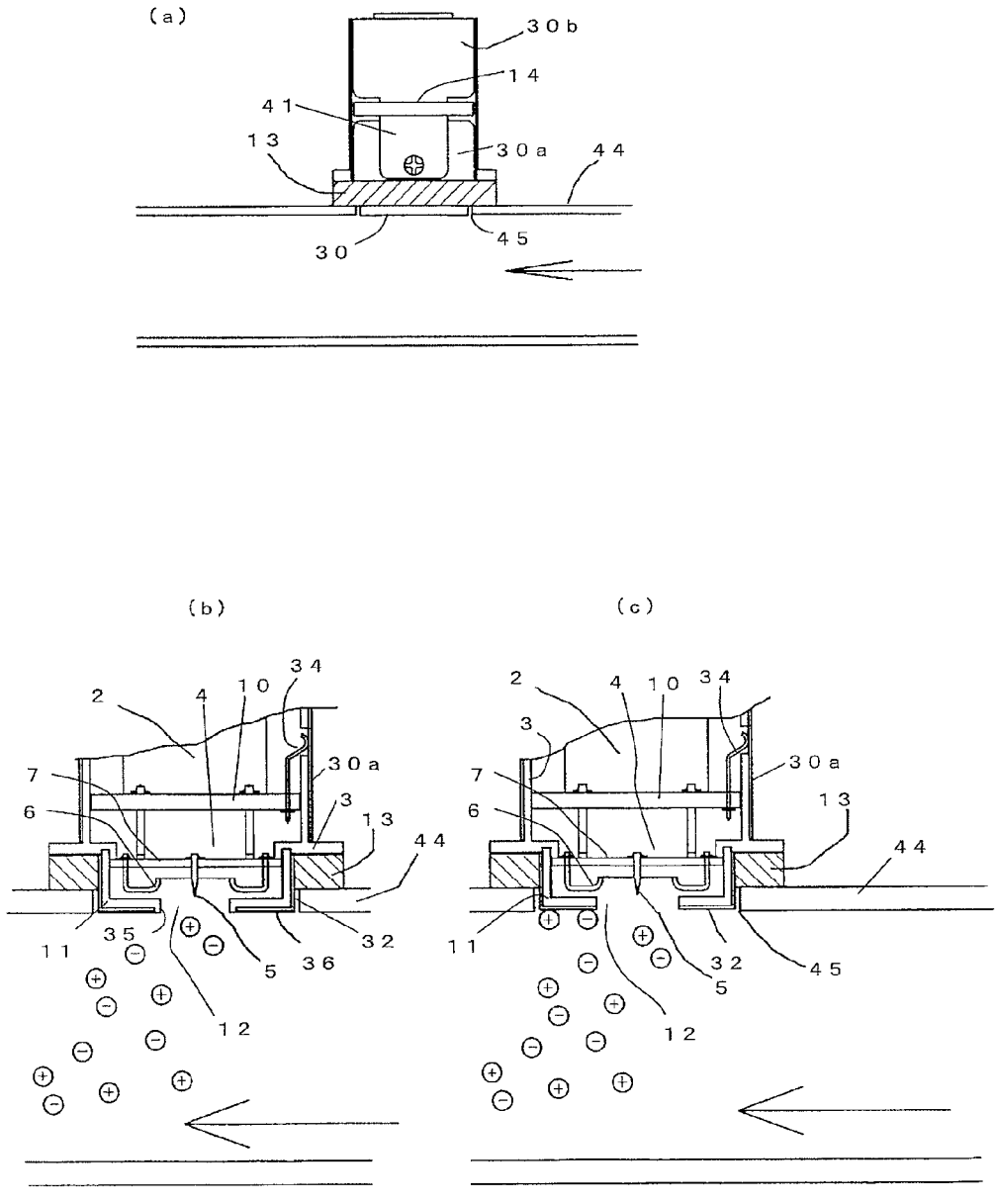
FIG. 5 shows the ion generating device mounted to a duct, FIG. 5(*a*) shows mounting, FIG. 5(*b*) shows a motion of ions with an insulating section, and FIG. 5(*c*) shows a motion of the ions without the insulating section.

The ion generating device assembled as described above is incorporated into an electrical device such as an air conditioner. The electrical device includes an air supply passage for emitting generated ions into a room by blowing air, and as shown in FIG. 5, the ion generating device is mounted to a duct 44 that forms the air supply passage.

A mounting port 45 is formed in a peripheral wall of the duct 44, and the discharge cover 11 of the housing 3 is fitted in the mounting port 45. The seal member 13 is sealed to an outer wall of the duct 44 to close a gap between the housing 3 and the duct 44, thereby preventing air leakage from the duct 44 to the outside.

The front surface of the discharge cover 11 of the housing 3 faces an inside of the duct 44, and the emission port 12 communicates with the duct 44. At this time, the covering sheet 36 is exposed to the inside of the duct 44, and hide the shield case 30 so as not to face the duct 44. The front surface of the discharge cover 11 slightly protrudes into the duct 44 beyond a peripheral wall of the duct 44. Thus, the front surface of the protruding section 32 covered with the covering sheet 36 is located inside the duct 44.

The high-voltage transformer drive circuit 23 operates to apply a high voltage between the discharge electrode 5 and the induction electrode 6. Corona discharge occurs at a tip of the discharge electrode 5 to generate at least one of the positive and negative ions. The generated ions are emitted from the emission port 12 into the duct 44. Blowing air in the duct 44 carries the ions, and wind containing ions with high concentration is blown out from an exit of the duct 44.

When both the positive and negative ions are generated, positive corona discharge is caused at a tip of one discharge electrode 5 to generate the positive ions. Negative corona discharge is caused at a tip of the other discharge electrode 5 to generate the negative ions. A high voltage of any waveform may be applied such as a DC waveform, an AC waveform biased to a positive or negative polarity, or a pulse waveform biased to a positive or negative polarity. A voltage value is selected from a voltage range that is required and sufficient for generating discharge, and produces predetermined ion species.

The generated positive ions are cluster ions with a plurality of water molecules attaching around hydrogen ions ($H^+$), and represented as $H^+(H_2O)_m$ (m is 0 or any natural number). The negative ions are cluster ions with a plurality of water molecules attaching around oxygen ions ($O_2^-$), and represented as $O_2^-(H_2O)_n$ (n is 0 or any natural number). When both the positive and negative ions are emitted, $H^+(H_2O)_m$ (m is 0 or any natural number) as the positive ions and $O_2^-(H_2O)_n$ (n is 0 or any natural number) as the negative ions in the air are generated in a substantially equal amount. Both the ions surround and attach to funguses or viruses suspended in the air, and an action of hydroxyl radical (.OH) of active species produced at that time can remove the suspended funguses or the like.

As shown in FIG. 5(*b*), since the covering sheet 36 is provided on the protruding section 32 of the shield case 30 facing the duct 44, the front surface of the shield case 30 that comes into contact with the ions is electrically insulated. Thus, the ions emitted from the emission port 12 do not adhere to the shield case 30. As shown in FIG. 5(*c*), without the covering sheet 36, the front surface of the shield case 30 is exposed to the outside. A part of the emitted ions are attracted by charges in the shield case 30 and adhere to the front surface of the shield case 30. This reduces ions emitted from the duct 44. An experiment showed that about 10% of ions adhered to the shield case 30. However, providing the covering sheet 36 prevents the ions from adhering to the shield case 30, thereby preventing a reduction in emitted ions, and ensuring sufficient ions emitted from the duct 44.

As such, it is important to provide the covering sheet 36 so that the outer surface that may come into contact with the ions in the shield case 30 is not exposed. Thus, the covering sheet 36 may be attached to also cover the end surface of the passage port 33 in the shield case 30. The covering sheet 36 does not need to be provided on the entire surface of the shield case 30. Specifically, the covering sheet 36 may be provided only on the outer surface of the shield case 30 to which the ions emitted from the emission port 12 in the housing 3 may adhere. For example, when the front surface of the protruding section 32 faces the duct 44, the covering sheet 36 is provided on the front surface of the protruding section 32. However, when the entire housing 3 is placed in the duct 44, the entire surface of the shield case 30 needs to be covered with the covering sheet 36.

Figure 6:
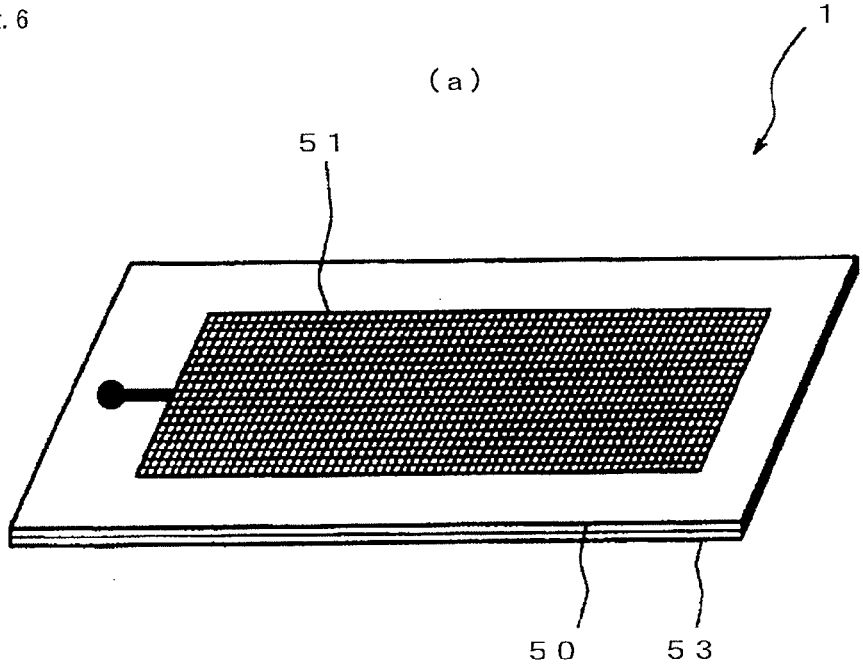
FIG. 6 shows an ion generating element of another embodiment, FIG. 6(*a*) is a perspective view, and FIG. 6(*b*) is a sectional view.
Figure 6:
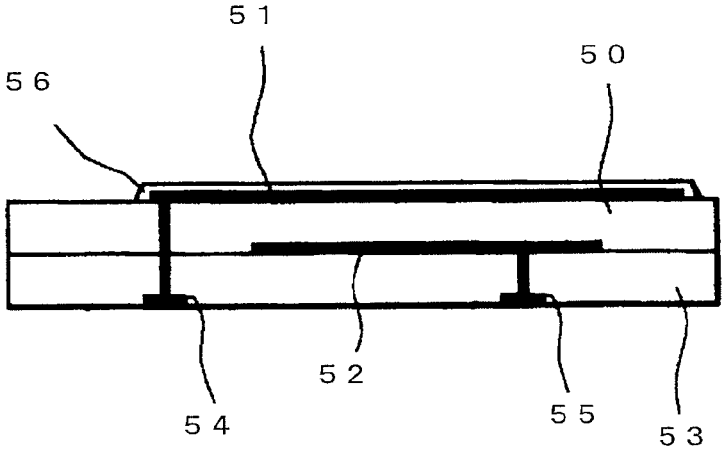

As shown in FIG. 6, an ion generating element 1 of another embodiment has a planar shape. A discharge electrode 51 and an induction electrode 52 are formed by printing with a dielectric 50 therebetween, and the induction electrode 52 is covered with another dielectric 53. Contacts 54, 55 that supply a voltage to the discharge electrode 51 and the induction electrode 52 are formed on a surface of the dielectric 53. The discharge electrode 51 is covered with a protective film 56 and prevented from wearing. The discharge electrode 51 alternately generates positive and negative ions in accordance with frequency of a power source.

Figure 7:
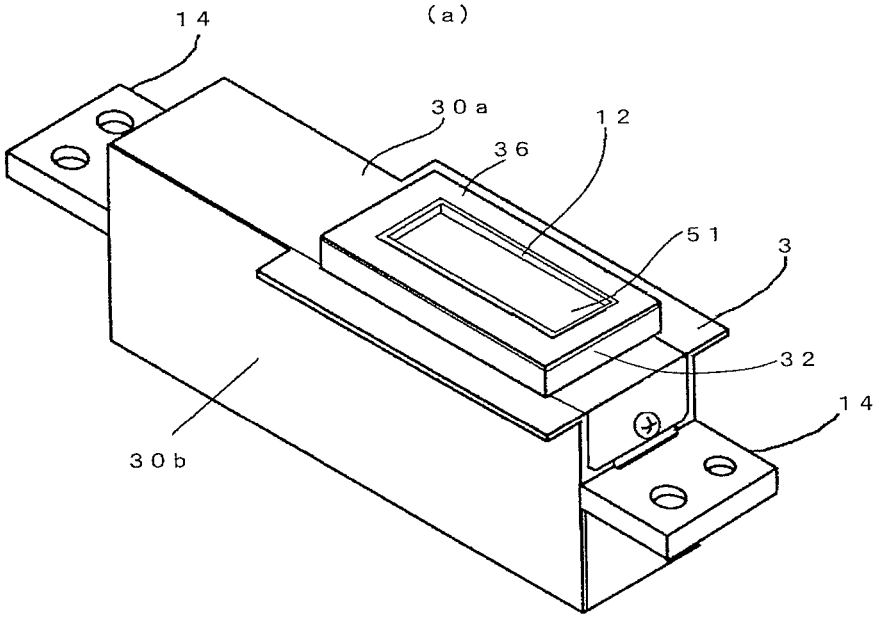
FIG. 7 shows an ion generating device including the ion generating element of another embodiment, FIG. 7(*a*) is a perspective view, and FIG. 7(*b*) is a sectional view.
Figure 7:
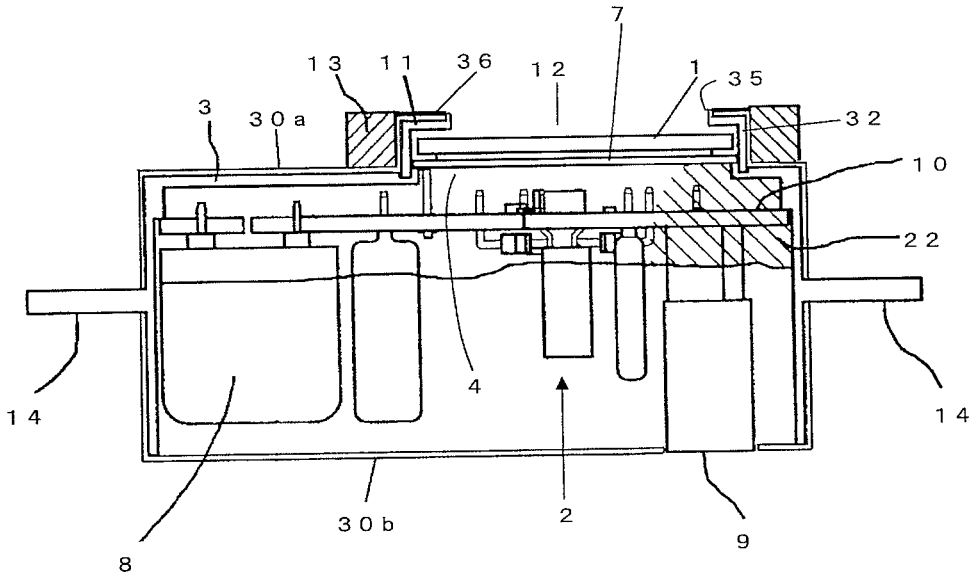

As shown in FIG. 7, the ion generating element 1 is mounted on the circuit board 7, and the circuit board 7 is fitted in the opening 4 in the housing 3. The discharge cover 11 covering the ion generating element 1 has a rectangular emission port 12 in accordance with a shape of the discharge electrode 51. A rectangular passage port 33 is formed in the protruding section 32 of the shield case 30 covering the housing 3. The covering sheet 36 is provided on the front surface of the protruding section 32 except the passage port 33. Other configurations are the same as those in the above described ion generating device.

The ion generating device is incorporated into an electrical device and mounted to the duct 44. Ions generated from the ion generating element 1 are emitted from the emission port 12 into the duct 44, but as described above, the ions do not adhere to the shield case 30, and wind containing the ions is blown out from an exit of the duct 44 by blowing air.

As described above, the housing 3 can be covered with the shield case 30 except portions that cannot be functionally covered, and thus electromagnetic noise can be more easily prevented than a case where a control board or an electronic component has a measure to reduce electromagnetic noise. Thus, the present invention can be applied to a device with a discharge or a small ion generating device including a high-voltage generating circuit section. Also when the ion generating device is mounted in various products including electrical devices such as an air conditioner, an air cleaner, a refrigerator, or a vacuum cleaner, or vehicles such as an automobile, electromagnetic noise can be prevented.

The present invention is not limited to the above described embodiment, but many modifications and changes may be, of course, made in the embodiments within the scope of the present invention. As the insulating section, an insulating film may be formed by coating. An electrically insulating material is applied or sprayed on the surface of the shield case with which ions may come into contact to form the insulating film.

No rib may be provided on the housing. In this case, the end surface of the passage port of the shield case is exposed. Thus, an insulating section such as a covering sheet is also provided on the end surface of the passage port.

REFERENCE SIGNS LIST

1 ion generating element
2 high-voltage generating circuit section
3 housing
4 opening
5 discharge electrode
6 induction electrode
11 discharge cover
12 emission port
22 filled resin
30 shield case
32 protruding section
33 passage port
35 rib
36 covering sheet

The invention claimed is:

1. An ion generating device, comprising:

a housing provided with a discharge cover having an emission port;

an ion generating element, housed in the housing, that generates ions;

a high-voltage generating circuit section, housed in the housing, that supplies a high voltage to the ion generating element;

a shield case that covers an outer surface of the housing and having a passage port that overlaps the emission port; and an insulating section that covers the shield case and prevents the emitted ions from adhering to the shield case, wherein the discharge cover has a rib formed in a periphery of the emission port, such that the rib covers an inner peripheral surface of the passage port;

wherein the insulating section is provided on the outer surface of the shield case.

2. The ion generating device according to claim 1, wherein the insulating section covers a periphery of the passage port.

3. The ion generating device according to claim 1, wherein the rib prevents the inner peripheral surface of the passage port from being exposed.

4. The ion generating device according to claim 3, wherein the rib protrudes outward.

5. The ion generating device according to claim 4, wherein the rib is flush with the insulating section covering an outer surface of the shield case or protrudes outward beyond the insulating section.

6. The ion generating device according to claim 1, wherein the insulating section covers the outer surface of the shield case facing a space into which the ions are emitted.

7. The ion generating device according to claim 1, wherein the insulating section is an insulating film provided on the outer surface of the shield case.

8. The ion generating device according to claim 2, wherein the insulating section is an insulating film provided on the outer surface of the shield case.

9. The ion generating device according to claim 3, wherein the insulating section is an insulating film provided on the outer surface of the shield case.

10. The ion generating device according to claim 4, wherein the insulating section is an insulating film provided on the outer surface of the shield case.

11. The ion generating device according to claim 5, wherein the insulating section is an insulating film provided on the outer surface of the shield case.

12. The ion generating device according to claim 6, wherein the insulating section is an insulating film provided on the outer surface of the shield case.

13. The ion generating device according to claim 3, wherein the rib is formed of an insulating material.

* * * * *